United States Patent [19]

Porco

[11] Patent Number: 4,540,980

[45] Date of Patent: Sep. 10, 1985

[54] PORTABLE SECURITY ALARM

[76] Inventor: Daniel Porco, 1050 5th Ave., New York, N.Y. 10028

[21] Appl. No.: 408,200

[22] Filed: Aug. 16, 1982

[51] Int. Cl.[3] ..... G08B 17/06; G08B 17/10; G08B 13/08

[52] U.S. Cl. ..... 340/586; 340/546; 340/593; 340/594; 340/628; 340/691; 340/693; 374/205

[58] Field of Search ..... 374/205; 340/586, 593, 340/546, 594, 693, 691, 590, 628

[56] References Cited

U.S. PATENT DOCUMENTS

| | | | |
|---|---|---|---|
| 2,552,331 | 5/1951 | Lamb | 340/590 |
| 2,816,280 | 12/1957 | Detweiler | 340/594 X |
| 3,555,532 | 1/1971 | White et al. | 340/630 |
| 3,878,539 | 4/1975 | Gooding | 340/546 |
| 4,178,592 | 12/1979 | McKee | 340/586 X |
| 4,186,389 | 1/1980 | Flittie | 340/628 |
| 4,284,981 | 8/1981 | Black | 340/546 X |
| 4,438,428 | 3/1984 | Ober et al. | 340/546 X |

FOREIGN PATENT DOCUMENTS

| | | | |
|---|---|---|---|
| 0090832 | 7/1980 | Japan | 340/693 |

*Primary Examiner*—James L. Rowland
*Assistant Examiner*—Thomas J. Mullen, Jr.
*Attorney, Agent, or Firm*—Russell E. Hattis; Stephen R. Arnold

[57] ABSTRACT

A portable room security alarm features a smoke detector alarm, a motion sensing intrusion alarm, a temperature sensing alarm, and a digital display alarm clock. The security alarm includes a deployable thermally conducting mounting clip for mounting the alarm at the top of a door with the clip extended to pass around the upper edge of the door. A deployable temperature sensor probe may be attached to the clip to give early warning of a fire outside the door. The temperature probe may alternatively be attached to other metallic structures passing through the door frame, e.g. door knobs, hinges, etc. Large ventilating apertures in an extensible telescoping housing allow access of smoke to the smoke sensor, and with the housing closed the sensor is sealed off against long term contamination.

12 Claims, 8 Drawing Figures

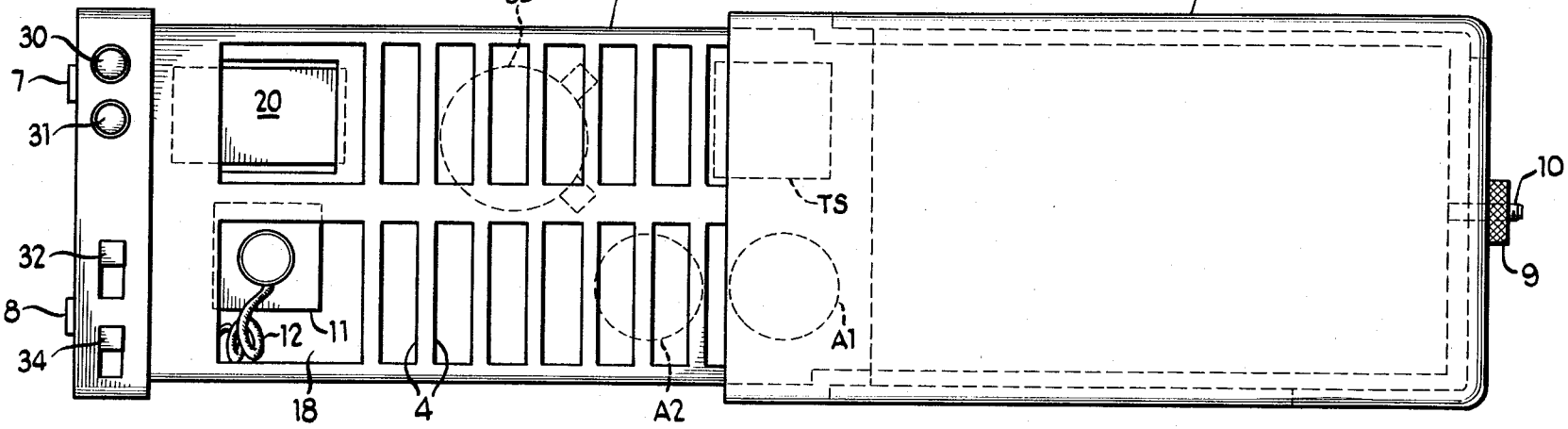
Fig 1C
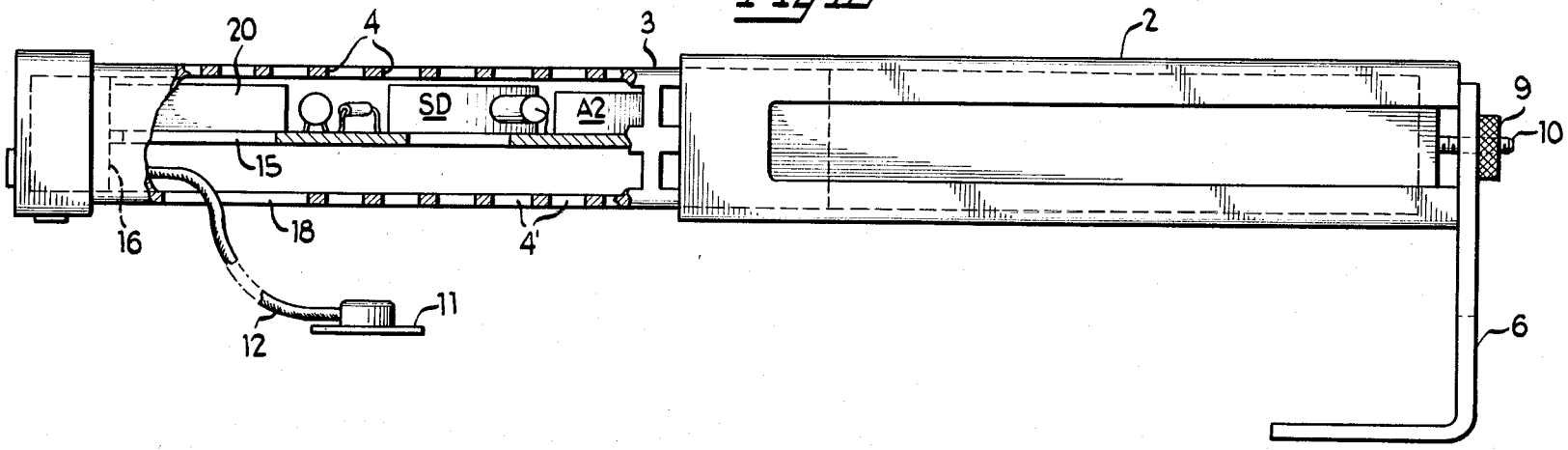
Fig III

PORTABLE SECURITY ALARM

TECHNICAL FIELD

An improvement in portable intrusion and fire alarm devices.

BACKGROUND OF PRIOR ART

Recent severe hotel fires have resulted in large numbers of people killed and injured. In addition to this problem, there are well known security problems arising from illegal entry into hotel rooms by burglars. Both of these problems have given rise to a need for a reliable portable intrusion and fire alarm apparatus that will warn the occupant not only of the existence of a fire in or close to his room, but also which will serve as an intrusion alarm in the case of unauthorized entry to the room. Such a unit must actuate audible alarm means to warn the occupant.

U.S. Pat. No. 2,552,331 issued to Lamb on May 8, 1951, discloses a portable electric alarm clock wherein an alarm means is automatically actuated when the temperature of the surrounding air reaches a predetermined value. U.S. Pat. No. 4,186,389 issued to Flittie on Jan. 29, 1980 discloses a similar arrangement, but uses a smoke detector instead of a temperature detector.

Such systems as disclosed in the latter of these patents, which employ a temperature sensor to warn the occupant of the existence of a fire, suffer from the disadvantage that the sensor does not sense the air temperature outside of the occupant's room but only that of the interior, the result being that by the time the temperature of the air in the room is sufficiently high to actuate the sensor and thereby warn the occupant, the fire outside the room door is frequently an impenetrable conflagration. Such devices suffer from a fundamental limitation that they sense the interior temperature of the room air, rather than producing a warning indicative of high air temperatures immediately outside the door to the room.

It is also commonly experienced that in the case of poorly fitting room doors, a substantial influx of combustion products containing toxic gases may penetrate the room to a dangerous level well advance of the rise of temperature outside of the room. It is thus desirable also that the portable alarm unit detect smoke in the room involved as well as a high temperature outside of it.

Prior art portable smoke and temperature detectors have not been heretofore associated with burglar alarms, so that the traveler does not have protection against entry of burglars into the hotel room involved.

In the most preferred form of the invention, there is incorporated into a single self-contained battery-powered unit of small size, all of the features just described.

BRIEF SUMMARY OF INVENTION

One of the features of this invention is the provision of a relatively small, inexpensive portable fire warning unit which a traveler can carry in his luggage and which is placeable in a position inside his room where it can respond to the air temperature on the exterior side of the room door. In its most preferred form, the portable alarm unit of the invention includes an extensible remote temperature sensor which can be affixed alternatively to the surface of a room door, or to various metallic portions of the door which are capable of communicating temperatures from outside the door to the interior, such as door hinges or the door knob or latch mechanism.

According to a more specific aspect of this feature of the invention, the extensible temperature sensor is fitted with magnetic attachment means to facilitate such mounting.

Also, preferably, the housing of the alarm unit is fitted with a metallic supporting clip configured to pass between a portion of the door jamb and the door edge to provide support for the assembly. (While one portable smoke detector alarm unit recently developed has a clip which hangs the unit on the top of a door, the unit otherwise is devoid of the other features of the invention.)

Means are provided for affixing the remote temperature sensor to the mounting clip on the inside of the door, such that the external high temperatures outside of the door are communicated along the clip so as to cause the sensor to actuate the temperature warning alarm, thereby providing an alarm more rapidly responsive to increasing exterior temperatures, as compared with cases wherein the temperature sensor is mounted on the inside surface of a conventional wooden door. According to another related aspect of the invention, the clip is preferably fabricated of ferromagnetic material so that the temperature sensor may be mounted by means of an associated magnet to the clip.

To minimize the size of the smoke-detecting form of the invention when stored in the traveler's luggage, and yet provide relatively large areas for entry of substantial amounts of smoke, the housing is made in separable parts movable between a collapsed dust-sealing condition and an expanded condition exposing relatively extensive smoke-entryways.

Still another feature of the invention is to provide in the portable unit just described means which sense an attempted jarring of the door of the room involved. A further feature of the invention is to incorporate an alarm clock into the alarm unit or units just described.

In accordance with a specific aspect of this feature of the invention, motion sensing means, preferably in the form of a trembler switch, is incorporated into the alarm unit so that the alarm, when either mounted on the door by means of a clip, or when simply placed against the door standing upright on the floor, will respond to movement of the door to actuate the alarm to warn the occupant of entry.

Other objects, advantages, and features of the invention will become apparent upon making reference to the description to follow, the drawings and the claims.

BRIEF DESCRIPTION OF DRAWINGS

FIG. 1C is a bottom elevational view of the extended unit shown in FIG. 1A showing a smoke sensor and trembler switch in dotted outline, FIG. 1D is a partially cross-sectioned side elevation of the alarm unit showing the clip in the extended disposition, and showing in functional detail a portion of the interior circuitry. An extensible temperature probe is shown deployed at the end of a cable;

DETAILED DESCRIPTION OF THE INVENTION

As shown in FIGS. 1A, 1B, 1C and 1D, the alarm unit of the invention illustrated includes a telescoping housing consisting of an exterior shell 2 and an interior shell 3. The interior shell 3 has air passages 4 penetrating the interior shell to be alternatively exposed to the surrounding air when the inner shell is pulled into an extended position from within the outer shell storage or sealed from dust and exposure when the inner shell is telescoped within the outer shell.

Figure 1A:
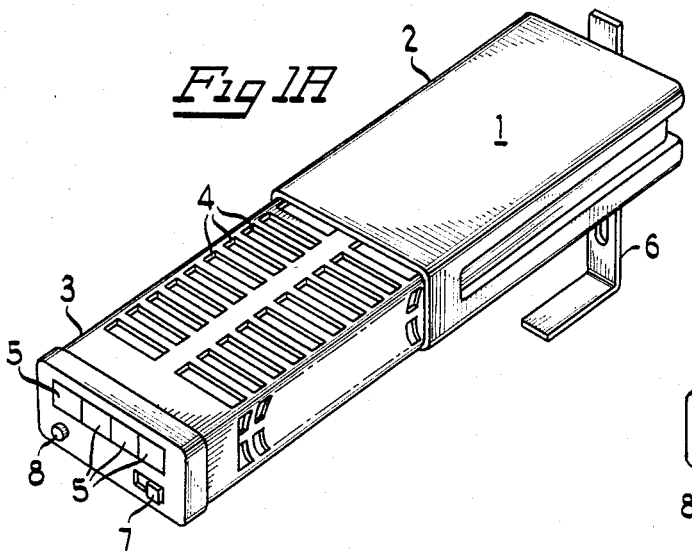
FIG. 1A is a perspective view of the alarm unit shown in an extended position with a mounting clip disposed extended for engagement with a door.
Figure 1B:
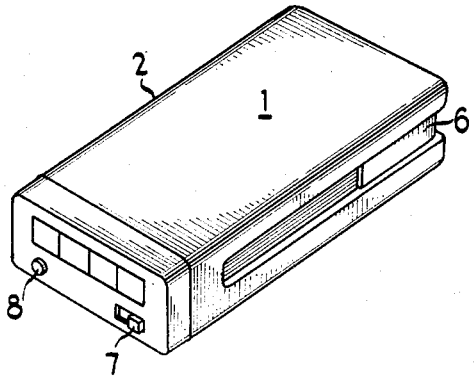
FIG. 1B shows the same unit in the closed configuration with the mounting clip in a stowed position.

A digital display alarm clock 16 of conventional design is mounted at the outer end of shell 3 to display the time by means of the digital display elements 5. Switch slide 7 (FIGS. 1A, 1B, 1C) actuates all security systems to an active state, wherein detection of smoke, high temperature, or door motion actuates a loud alarm A2. Indicator light 8 gives a visual display of the status of the system. When the system is armed the display light 8 is continuously winking. Pushbuttons 30 and 31 and switch slide 32 shown in FIG. 1C are used to set the clock both to the current time and to the preset time at which the clock alarm A1 is to be actuated. Switch slide 34 sets the clock to alarm mode, whereby clock alarm A1 of moderate intensity is actuated at a preset time.

A mounting clip 6 is rotatably and slidably affixed to the rear of the outer shell 2 by means of a threaded shaft 10 mounted rigidly to the outer end of the outer shell and secured by a threaded knob 9 such that by screwing or unscrewing the knob, the clip 6 may be locked in deployed or stowed configuration.

FIGS. 1C and 1D show in functional form the location the principal elements of the alarm system, including a temperature sensing probe 11 deployed on the end of a cable 12 communicating to the interior circuitry mounted on a circuit board 15. The temperature probe 11 and cable 12 may be placed inside of the inner shell 3 for storage through a storage passage 18, whereby the probe and cable are self-contained inside the housing in the stored configuration. Additionally shown on circuit board 15 are a trembler swtich TS, a smoke detector element SD, two audible alarm elements A1 and A2, and a system battery 20. A detailed description of the circuit for this system will be presented subsequently.

The smoke detector SD is placed opposite the large air passages 4 in the walls of the interior shell 3. Since the passages 4 are completely covered in the closed configuration shown in FIG. 1B, long-term dust accumulation on the exposed elements of the smoke sensor SD is minimized, thereby markedly increasing the useful life of the sensor before cleaning or replacement becomes necessary.

Figure 2A:
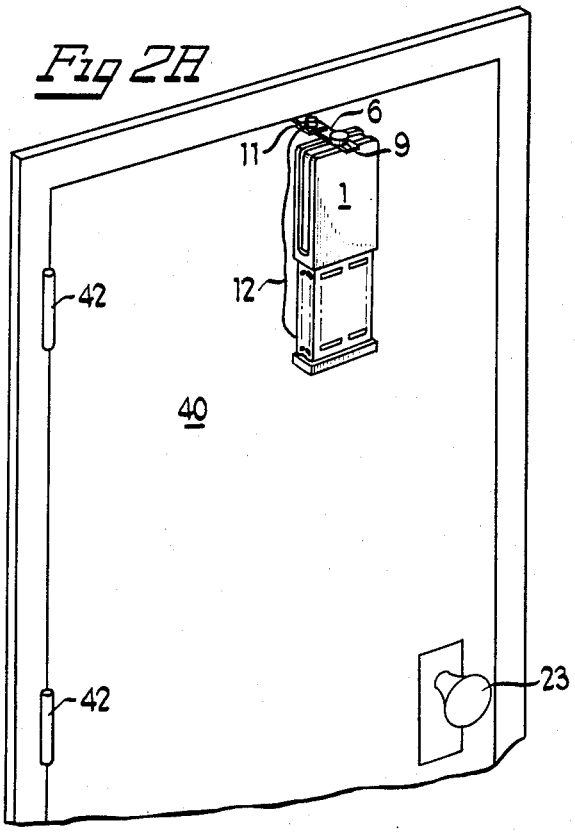
FIG. 2A is a view of the alarm unit mounted on the upper part of a door, with the temperature probe cable affixed to the mounting clip passing through the top of the door jamb.

FIG. 2A illustrates one mode of mounting of the alarm unit, wherein the clip 6 is positioned to extend past the jamb of a door 40 with the temperature sensor 11 mounted on the clip 6 near the knob 9. In such a configuration the rise of temperature on the far side of the door during a fire will communicate a rise in temperature to the temperature sensor 11 mounted on the inside end of the clip as shown, thereby actuating the loud audible alarm A2 to warn the occupant. Thus, by responding to the temperature on the outside of the door, a substantial improvement in fire protection is achieved.

Additionally, passage of smoke through the passages 4 to the smoke detector SD will cause the alarm to be actuated. The trembler switch TS shown in FIG. 1D is also connected to actuate the loud audible alarm A2 of FIGS. 1C and 1D if the door is opened, as by an intruder.

Figure 2B:
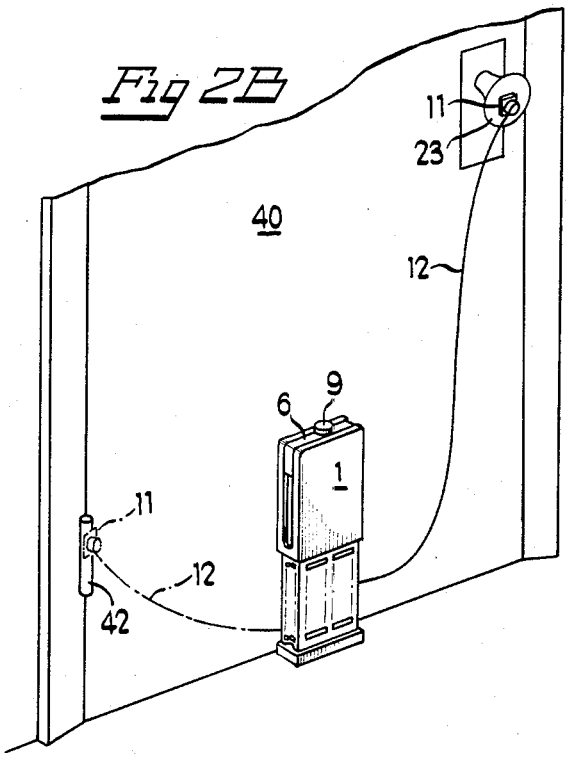
FIG. 2B shows an alternative mounting arrangement wherein the clip is in the stowed position with the alarm unit positioned against the door while mounted on the floor, with the temperature probe connected to a door knob or alternatively to a hinge.

FIG. 2B shows an alternative disposition of the alarm unit 1 for those cases where the door jamb is too tightly fitted to allow deployment of the mounting clip 6. Here the alarm unit 1 is placed on the floor next to the door, with the temperature probe 11 affixed to the door knob or latch mechanism 23. Such latch units typically involve a steel actuating bar passing through the door to corresponding metal latch elements on the other side. In case of fire on the far side of the door, the door latch assembly on the inside will frequently heat up much more quickly then will the door surface itself, particularly if the door is of conventional wooden construction, or if it is of the more modern insulated construction. Thus, the thermally conducting properties of the door latch assembly are used in conjunction with an extensible temperature probe to give early warning of fire outside.

FIG. 2B shows an alternative configuration wherein the temperature probe is deployed on one of the door hinges 42. Here again, hinge assemblies penetrate well into door frames, and will communicate an indication of a fire outside to the temperature sensor.

Figure 2C:
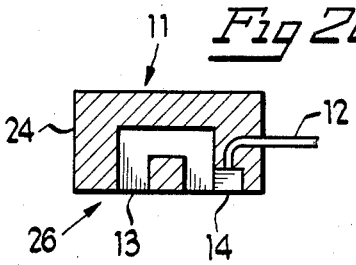
FIG. 2C is a partial cutaway view of one form of temperature probe assembly showing a mounting magnet and a temperature sensing element potted in a common block.

FIG. 2C shows one form of mounting system for such a temperature sensor 11, wherein a temperature element 14 connected to the remote cable 12 is placed in proximity to an attachment magnet 13, the entire structure being held together in the form of a block 24 by a potting compound of conventional type to form a rigid assembly with the sensor disposed at the attachment face 26. Such a magnetic attachment means is particularly useful, since virtually all present day door hinges and door latch or knob structures are made of steel.

To facilitate attachment of the temperature probe of FIG. 2C to the mounting clip 6 when deployed as shown in FIG. 2A, the clip itself is preferably made of steel, so that with the probe assembly of FIG. 2C mounted thereon a good thermal contact is assured.

A commercially available combination alarm, the "Personal Security Alarm", manufactured by Omnitronics Research Corp. 3085 W. Market St., Akron, Ohio, employes a deployable door-top support clip in conjunction with a switch actuating lever contacting the door jamb to actuate an intrusion alarm. No temperature sensor is employed in this unit, and the sole fire warning means is a smoke detector. Neither the concept of a deployable heat sensor nor the concept of using the conducting properties of the clip as a temperature relay to the inside of the room are embodied in this device.

Figure 3:
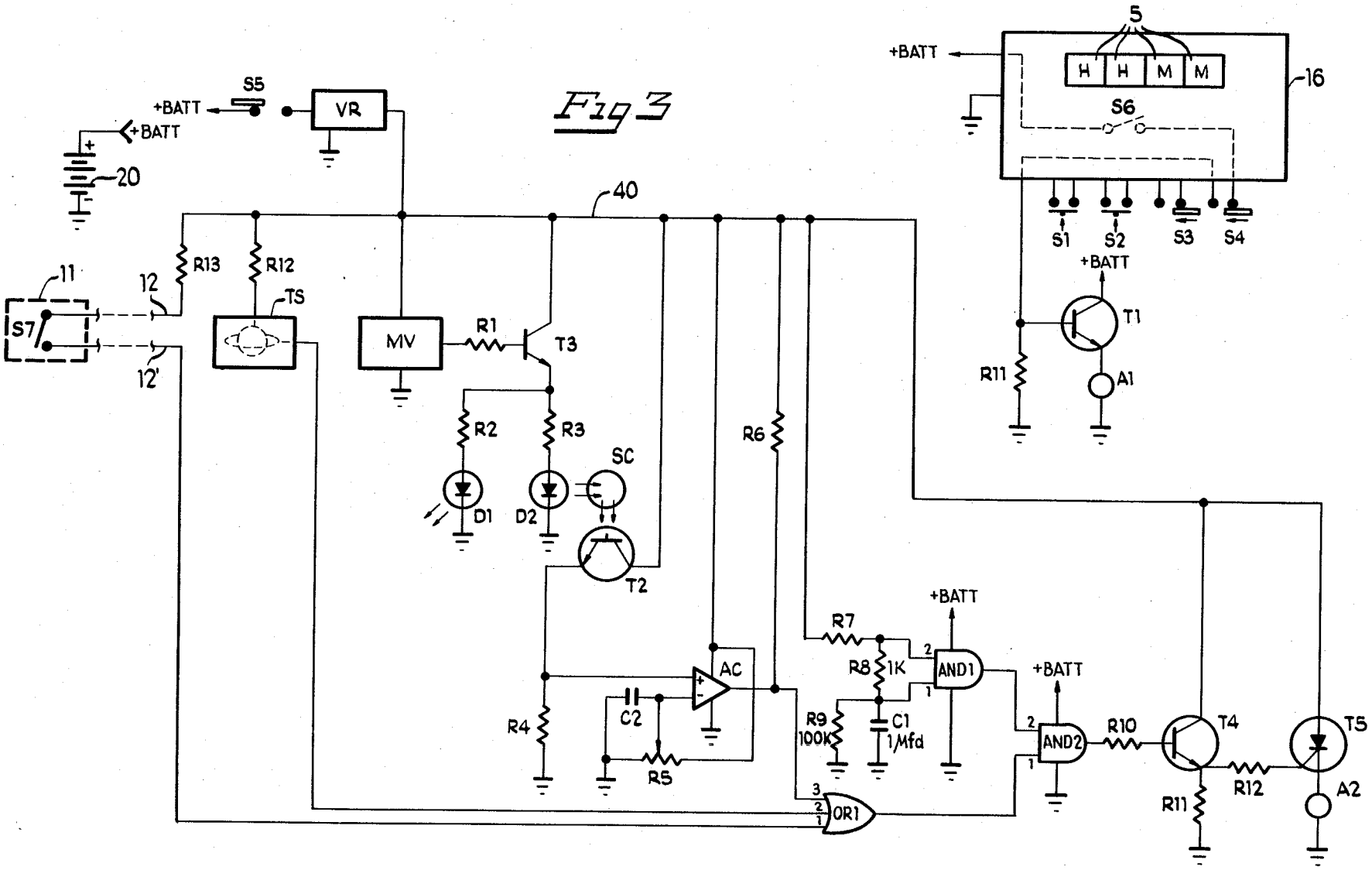
FIG. 3 is a circuit schematic for the fire alarm system, including a clock radio, a smoke sensor, a motion sensor, and an extensible probe.

The circuit for the preferred form of the alarm unit is shown in FIG. 3. The battery 20 provides power for the entire system, providing continuous power to the digital alarm clock 16 characterized by digital display elements 5 showing the hours and minutes of the day. Because of the low current drain of such units, in the preferred embodiment the alarm clock 16 is allowed to run continuously. Three switches S1, S2 and S3 corresponding to pushbuttons 30 and 31 and slide 32 shown in FIG. 1C serve to adjust and set the clock. Switch S4 is actuated by a slide 34 in FIG. 1C and when in a closed position serves to set the alarm clock to a hand alarm mode such that when a preset alarm time is registered by the clock 16, interior switching means, here functionally shown as switch S6, are actuated to a closed position to deliver battery power to the base of a transistor T1, the base being returned to ground via resistor R11. Transistor T1 is of the n-p-n type, hence raising the base applies positive bias to place the emmitter into a forward conducting condition, thereby supplying power from the collector to the alarm A1 and then to ground, thereby actuating the alarm A1 (which is of moderate intensity) to a ringing condition. Alarm A1 may be of any of a variety of alarms well known in the art and may include visual means as well.

The remainder of the circuitry is devoted to the three additional alarm means, i.e., temperature alarm, intrusion alarm, and smoke alarm. Switch S5 is actuated by slide 7 shown in FIGS. 1A, 1B and 1C such that when switch S5 is closed battery power is supplied to the security alarm system. With switch S5 closed battery power is supplied to an alarm system rail through a conventional voltage regulator VR, to provide a rail voltage of nominal value 5 volts. The rail voltage is applied through resistor R13 to the temperature sensing element 11 via leads 12 and thence to one input terminal of gate OR1. In the preferred embodiment, the temperature sensor 11 is simply a bimetallic switch S7 of a type well known to the art, wherein at a critical temperature the switch actuates from an open to a closed condition, indicating that its temperature has been raised above a given threshold level. Thus, when the temperature sensed by the temperature sensor 11 is above this value, gate OR1 is enabled, thereby placing a "1" state at the input of gate AND2. Such a condition will subsequently be shown to actuate the loud alarm A2. Leads 12'—12' comprise the interior elements of sensor cable 12 in the various figures.

Similarly, when switch S5 is closed, placing the security alarm systems in an armed condition, the motion switch, or trembler switch TS is supplied with battery power through resistor R12. The trembler switch TS may be of any one of a variety of conventional designs, preferably of the self-erecting type, wherein after a limited period of time after movement the switch automatically erects itself to a non-conducting state. Such switches are commonly used to prevent automobile theft, and are used for a variety of other motion sensing puposes. Here the trembler switch TS is shown in functional form represented as a spherical ball suspended midway between a conductive ring, acceleration of the switch causing the ball to displace and contact a ring thereby producing closure of the switch to supply battery power to imput 2 of gate OR1, to place a "1" at input terminal 1 of gate AND2, again actuating the alarm means A2. Thus, any sudden motion of the security alarm, as for example by opening of the door with the alarm mounted thereon as shown in FIG. 2A, will result in actuation of the security alarm A2.

The smoke sensing circuit may be designed in a variety of ways. The preferred form of smoke detector is of the general type disclosed by White et. al. in U.S. Pat. No. 3,555,532, issued Jan. 12, 1971, the details of which are incorporated herein by reference. Such a smoke sensor operates by admission of ambient air into a cylindrical chamber with a blackened interior denoted schematically in FIG. 3 by a dotted circle SC. Light from a source is directed into the chamber, the presence of smoke being detected by light scattering off the smoke particles at right angles to the entrance beam, to be picked up by a phototransistor T2. A smoke level above a given value causes a measurable change in the properties of the phototransistor T3, thereby causing actuation of associated alarm means.

To minimize battery drain arising from the necessity for a fairly intense light source to illiminate the scattering chamber SC, a conventional pulsed light source circuit is used wherein the light source which illuminates the chamber, here taken to be a light emitting diode D2, is turned on for short periods of time at a relatively low repetition rate, thereby holding the current drain on the battery 20 to acceptably low levels. As will subsequently be discussed, the alarm circuit which actuates security alarm A2 is a circuit which latches to the ON condition when smoke is detected in the chamber SC during any of the ON periods of the light emitting diode D2.

In more detail, a conventional free running multivibrator MV of conventional design outputs a short positive voltage pulse of approximately one quarter second duration at a rate of one pulse every 10 seconds to drive the base of transistor T3 through a current limiting resistor R1. The collector of transistor T3 derives its power from the alarm system rail 40. The emitter of transistor T3 excites the chamber-illuminating diode D2 through resistor R3 to ground. Thus, the sensing chamber SC is illuminated for approximately on quarter of a second every 10 seconds. Also connected to the emitter of transistor T3 through resistor R2 is light emitting diode D1 with its cathode side grounded. This light emitting diode will therefore wink on and off every ten seconds to serve as an indication to the user that the system is configured in the alarm state. Light emitting diode D1 is to be associated with the arming light 8 shown in FIGS. 1A, 1B and 1C.

A phototransistor T2 characterized by a floating base, and having its collector connected to the alarm supply rail 40, has its emitter grounded through resistor R4, and is disposed to intercept scattered light exiting the chamber SC. As the smoke level rises, scattered light illuminating the photo transistor T2 causes the current passed by transistor T2 to rise in value, raising the ungrounded terminal of resistor R4 to increasing positive values. This terminal is fed to the non-inverting input terminal of an amplitude comparator AC of conventional design. The amplitude comparator AC also derives its power from the alarm system rail 40. A positive adjustable threshold voltage is fed to the non-inverting input terminal of the amplitude comparator AC from a potentiometer R5 connected between ground and the alarm system rail 40.

Thus, at low illumination levels the potential applied to the non-inverting input via resistor R5 dominates, causing an output of the amplitude comparator to be held in low or "0" state. As the smoke level rises and the input signal level at the non-inverting input terminal correspondingly rises, ultimately the amplitude comparator changes state to cause the output of the amplitude comparator AC to go high, thereby driving input T3 of gate OR1, to which it is connected, to a high state. Thus, a smoke level in the chamber SC above a certain value causes the actuation of the output of gate OR1 in the same manner as the trembler switch TS and thermal sensor switch S7.

It will be recalled that actuation of any of the sensors to a warning state places a high state on pins 1, 2 or 3 of gate OR1, thereby causing the input of pin terminal 1 of gate AND2 to go to a high state. Since the smoke warning signal is in the form of pulses, and since the output of the trembler switch would typically expect to be an erratic series of pulses as the door is opened, it is essential that the circuit driving the security alarm A2 be of the latching type, so that receipt of any such warning pulse causes the alarm to be continuously driven. Furthermore, the latching circuitry which drives alarm A2 must not be falsely triggered into a latched on condition by closing the arming switch S5.

To this end, a delay in the initial response of the alarm system is secured by provision of delayed gating means involving gate AND1. Input terminal 2 of gate AND1 is supplied directly from the alarm rail 40 through a pull-up resistor R7. Input terminal 2 of gate AND1 follows the rise of input terminal 1 at a delayed rate, since input terminal 1 of gate AND1 is bypassed to ground through a substantial capacitor C1 of the order of one microfarad, input terminal 2 being connected to terminal 1 through a resistor R8 of nominal value 1,000 ohms. When switch S5 is closed, pin 1 will not rise immediately, but will reach a "1" state approximately 1 millisecond after input terminal 2. Thus, the output of gate AND1 is delayed, and does not go to a 1" state until approximately one millisecond after the actuation of the arming switch S5. A bleeder resistor R9 of nominal value 100,000 ohms is connected across capacitor C1, and serves to bleed off the stored charge on the capacitor when the alarm arming switch S5 is opened, thereby preparing the system for the next closure of this switch.

The output of gate AND1 is connected to input terminal 2 of gate AND2 will be held in a "Q" state for the order of a millisecond after closure of the arming switch, the system transients arising from the arming process, in particular possible transients arising from the amplitude comparator or gate OR1 during the power-up process, will not be passed to the output of gate AND2. To insure against problems arising from internal transients arising inside of gates AND1 and gates AND2, they are chosen to be of the CMOS low current variety, and they are powered directly from the system battery. The output of gate AND2 therefore cannot become active until transients in the sensing circuitry have subsided.

With the arrival of a warning signal at any of the three inputs of gate OR1, after the system is armed and stable, the warning signal then appears at the output of gate AND2, driving the base of transistor T4 through resistor R10. The transistor T4 is of the n-p-n variety. Its collector is tied to the alarm rail 40, and it is configured as an emitter follower with a load resistor R11 between its emitter and ground. Actuation of gate AND2 to a high output state pulls the base of transistor T4 from a grounded condition to provide a forward biasing condition at the emitter, resulting in a rise in positive potential at the ungrounded end of resistor R11, this potential being communicated to the trigger electrode of triac T5 through a current limiting resistor R12. The triac T5 also derives its power from the alarm rail 40, and has its cathode grounded through alarm A2. Once actuated by a trigger signal through R12, triac T5 remains latched in the ON condition to continuously activate the loud alarm A2 until the arming switch S5 is opened, thereby removing the power from all elements of the security alarm system except gates AND1 and AND2. The alarm clock unit 16 remains active at all times.

The circuit as shown in FIG. 3 represents an economical approach to achieving the requirements of the system, however, other variations may be employed. Thus, for example, the sensing switch S7 need not be of the bimetal variety, but may be of the more elaborate semiconductor sensing variety wherein a change in collector leakage resistance varies with temperature to cause signal level changes in associated circuitry. The delay circuit associated with gates AND1 and AND2 is designed simply to allow ordinary transients to subside in the system to insure that triac T5 is not prematurely triggered when the system is armed. One extension of the system would include a provision for a much longer delay, typically of the order of seconds, or possible even minutes, to elapse before this system is armed, in order that more sensitive trembler switches may be used. Such delays may be accomplished for example by means a ripple counter driven directly from the free running multivibrator to actuate the input terminal of gate AND2 to an active state seconds or minutes after the arming switch S5 is closed, thereby allowing the employment of extremely sensitive, but slowly self-erecting, trembler switches to be employed.

Thus, a security alarm system has been described which offers a substantially improved degree of protection against fire by use of a deployable temperature sensor and a thermally conducting clip which relays rises in exterior temperature to the alarm. The reliability of an associated smoke sensor has been increased by use of a large aperture telescoping housing that seals the sensor against dust when the alarm is not in use. An additional intrusion alarm and an incorporated alarm clock add to the overall usefuless of the system.

While for the purpose of illustration, various forms of this invention have been disclosed, other forms thereof may become apparent to those skilled in the art upon reference to this disclosure and, therefore, this invention shall be limited only by the scope of the appended claims.

I claim:

1. In a portable fire alarm unit including a housing supportable on or adjacent to the inner side of a door of a room and containing alarm warning means, temperature sensing means, and fire alarm control means responsively coupled to said temperature sensing means and responding to a sensed temperature above a given value for causing actuation of said warning means;

the improvement wherein said alarm unit is provided with thermally conducting means, a first portion of which is configured to pass at least partially along the edge of said door and towards the opposite side of said door, and a second portion proximate to said first portion and which is adapted to accept said temperature sensing means in thermal contact with said second portion, said alarm unit further including means for removably selectively affixing said temperature sensing means in thermal contact with a chosen thermally conducting structure associated with said door and thermally communicating with the other side of said door or alternately with said second portion of said thermally conducting means, so that with said thermally conducting means so mounted on a door and passing substantially therearound and with said temperature sensing means affixed to said second portion of said conducting means, a temperature level indicative of the temperature on the opposite side of the door will be communicated along said thermally conducting means to actuate said alarm, and so that with said temperature sensing means alternatively mounted on said thermally conducting structure associated with said door and thermally communicating with said other side of said door, said warning means will be similarly actuated.

2. The alarm unit of claim 1 wherein said alarm unit is electrically powered and has a housing permanently containing or supporting most of said means, said temperature sensing means is remotely locatable from said housing, and there is provided electrical conductor means extending between said sensing means and said housing, and means for removably affixing said temperature sensing means in thermal contact with said chosen thermally conducting structure associated with said door and communicating with the other side of said door or with said second portion of said thermally conducting means.

3. The fire alarm unit of claim 1 or 2 wherein said thermally conducting means comprises mounting means for removably mounting the alarm unit on the face of a door near the top edge thereof.

4. In a portable fire alarm unit including a housing supportable on the face of door facing a room and containing alarm warning means; temperature sensing means for providing a sensing condition thereat indicative of the sensed temperature, and fire alarm control means coupled to said temperature sensing means and responding to a sensed temperature above a given value by said sensing means for causing actuation of said warning means; the improvement wherein said alarm unit is provided with thermally conducting means, a first portion of which is configured to pass at least partially along one of the edges of said door and towards the opposite side of said door, said thermally conducting means being a mounting means for removably mounting the alarm unit on the room-facing side of a door and a second portion of which extends beyond said room-facing side and into said room; and means for affixing said temperature sensing means to said thermally conducting means to be in thermal contact with said second portion thereof and thus to respond to temperature changes on the opposite side of said door.

5. The fire alarm unit of claim 4 wherein said mounting means forms a bracket which is engageable over the top edge of the door.

6. In a portable fire alarm unit including a housing supportable on or adjacent to a door of a room and containing electrical alarm warning means and fire alarm control means for controlling the flow of electrical power to said warning means, the improvement wherein said alarm unit is provided with:

electrical temperature sensing means remotely locatable from said housing for producing an electrical signal condition indicative of the sensed temperature;

signal lead means from said temperature sensing means to said fire alarm control means for communicating said signal condition to said fire alarm control means, said fire alarm control means responding to a signal condition corresponding to a sensed temperature above a given value to cause actuation of said warning means; and means for removably affixing said temperature sensing means to be in thermal contact with a chosen heat conducting structure associated with said door and thermally communicating with the other side of said door so that with said temperature sensing means mounted on said thermally conducting structure, said warning means will be actuated responsively to a temperature rise at said other side of said door.

7. The alarm unit of claim 4 or 6 wherein said means for affixing said temperature sensing means includes a permanent magnet on said temperature sensing means.

8. The alarm unit of claim 4 wherein said means for affixing said temperature sensing means includes a permanent magnet on said temperature sensing means, and at least part of said second portion of said thermally conducting means is made of a ferro-magnetic material to receive said magnet.

9. The alarm unit of claim 6 further comprising means for mounting said housing upon said door;

electrical motion detecting means disposed within said housing for producing a second electrical signal condition indicative of movement of said housing; and motion detecting control means communicating with said motion detecting means and responsive to said second signal condition for actuating said warning means when said alarm mounted thereon or placed thereagainst actuates said warning means to act as an intrusion alarm.

10. The alarm unit of claim 6 further comprising:

electrical smoke detection means in said housing for producing an electrical signal condition indicative of the presence of smoke; and smoke detection control means associated with said smoke detection means and responsive to the latter electrical signal condition for actuating said warning means when smoke is present.

11. The alarm unit of claim 10 wherein said housing has at least one aperture in the walls thereof to admit the passage of smoke to said smoke sensor, and said housing is configured in the form of a pair of extensible telescoping shells operable to a first nonextended configuration and a second extended configuration, with apertures penetrating at least one of said shells and disposed so as to be sealed by the other shell when said pair is in said first configuration and alternatively open to allow air passage to the interior of said housing and said smoke detection means when said pair is in said second configuration, so that with said pair in said second configuration smoke in the surrounding air can pass to be detected by said smoke detecting means, and so that with said pair in said first configuration said housing is compact and substantially sealed.

12. The alarm of claim 1, 4, 6 or 11 further comprising an alarm actuating clock disposed in said housing, said clock including a time alarm control means for actuating said warning means at a predetermined selected time.

* * * * *